United States Patent [19]

Mahon

[11] Patent Number: 4,551,590

[45] Date of Patent: Nov. 5, 1985

[54] APPLIANCE CONTROL AND PROGRAMMER TIMER THEREFOR

[75] Inventor: Joseph J. Mahon, Libertyville, Ill.

[73] Assignee: Eaton Corporation, Cleveland, Ohio

[21] Appl. No.: 610,225

[22] Filed: May 14, 1984

[51] Int. Cl.[4] ..... H01H 43/00

[52] U.S. Cl. ..... 200/38 R; 200/38 B

[58] Field of Search ..... 200/33–38, 200/39; 368/108, 109

[56] References Cited

U.S. PATENT DOCUMENTS

| | | | |
|---|---|---|---|
| 3,603,749 | 9/1971 | Davis | 200/38 C |
| 3,717,043 | 2/1973 | Cartier | 200/38 B X |
| 3,824,365 | 7/1974 | Tapper | 200/38 B X |
| 4,153,824 | 5/1979 | Blackmond | 200/35 R |
| 4,467,664 | 8/1984 | Willigman et al. | 20/38 B X |

*Primary Examiner*—J. R. Scott

*Attorney, Agent, or Firm*—C. H. Grace; R. A. Johnston

[57] ABSTRACT

A control system and programmer/timer for a microwave oven having a program cam advanced by a pawl-stepped ratchet wheel having three toothed segments, each with teeth of differing root diameter. The outer teeth provide rapid expanded scale advancement for the terminal five minutes of the cooking program and also for selected programs of five minutes or less for high-resolution switching by the program cam. The segment of teeth of intermediate root diameter provides a compressed scale slower cam advance rate for "COOK" programs of 5–35 minutes. The segment of teeth of lowest root diameter provides slow rate cam advancement for auxiliary "DELAYED START" and KEEP-WARM functions where time accuracy is not critical. The programmer/timer enables continued advancement of the program cam after time-out of the cooking program where the KEEP-WARM mode has been preselected.

15 Claims, 6 Drawing Figures

APPLIANCE CONTROL AND PROGRAMMER TIMER THEREFOR

BACKGROUND OF THE INVENTION

The present invention relates to the programming of an electrically operated appliance in which it is desired to operate the device for a selected program interval during which various operations are performed in a desired sequence. Program controllers of this type are employed in household appliances such as microwave cooking ovens and clothes dryers. In appliance applications of the aforesaid type, the appliance operator selects a desired sequence of operation by prepositioning a control member such as a push button or lever on the appliance control panel and then selects a program interval on a timer control for energizing the timer to actuate the various appliance control functions during time-out of the program interval.

Examples of such programmer timer devices and techniques for electrical appliance programming are those described in my copending applications Ser. No. 490,269, filed May 2, 1983, now U.S. Pat. No. 4,523,062 and Ser. No. 495,895, filed May 18, 1983. In these earlier copending applications, I have described a timing mechanism employing a ratchet and pawl advance mechanism for a switch-actuating program cam. The aforesaid described ratchet and pawl advance mechanism employs a toothed ratched wheel having two arcuate segments of teeth of different root diameters. A masking ratchet employing sequenced deep notches permits the single oscillating advance pawl to contact the ratchet teeth of the lowest root diameter only upon predetermined multiples of the pawl stroke for giving plural advance rates to the ratchet wheel.

In addition, the aforesaid copending applications describe a system for cycling an auxiliary appliance function at subintervals of the program interval during a dwell period in the program cam advance upon completion and time-out of the appliance program interval. The problem encountered with subinterval cycling of the appliance function during dwell of the program cam is that it has heretofore not been possible to provide a way or means of automatically restarting the program cam advancement with a single ratchet advance pawl mechanism once the pawl has reached a toothless portion of the ratchet wheel for interrupting the advance of the cam.

Heretofore, in programmer/timers for controlling appliances, where it has been desired to provide plural cycling rates of the appliance during the program interval, multiple timing advance mechanisms employing more than one timing motor and cam advance mechanism have been required to provide the plurality of program cam advancement. Thus it has long been desired to provide a simple, low cost controller timer for an appliance which employs only a single timing motor with a single-pawl ratchet advance mechanism and provide for plural rates of advance of the program cam. It has further been long desired to provide continued subinterval duty cycling of the appliance function after time-out of the main program interval without requiring the ratchet advance mechanism to reach a dwell in order to provide the subinterval cycling.

SUMMARY OF THE INVENTION

The present invention provides improved program control and a programmer/timer for energizing an electrical appliance for a selected program interval and provides for sequential operation of various appliance functions during the time-out of the selected program interval. The present invention employs a single timing motor driving a single oscillating advance pawl for contacting a toothed ratchet wheel to provide advancement of a program cam which sequentially actuates and deactuates a plurality of switches for controlling the various appliance functions during the program interval.

The present invention employs a toothed advance ratchet having segments of teeth with different root diameters and a masking ratchet wheel which permits the advance pawl to contact the teeth of different root diameters only once in each of a multiple number of pawl strokes to thus provide different rates of advance for the ratchet wheel when the pawl contacts teeth of different root diameter. The ratchet wheel employs three segments of teeth with the teeth in each segment having a root diameter differing from those of the adjacent segment. The masking ratchet wheel employs a deep notch which occurs at a selected multiple of the peripheral teeth to permit the pawl to drop into contact with teeth of lesser root diameter only when the pawl encounters the deep notch in the masking ratchet for compressed scale or slower rate of advancement. The masking ratchet also employs an extra deep notch to permit the advance pawl to contact the teeth of smallest root diameter for advancement at the slowest rate and termination of the program.

The programmer/timer of the present invention employs an advance ratchet having teeth segments of three levels of root diameter which are variably masked such that the advance pawl contacts a tooth of the outer level on each stroke thereof and contacts teeth of the intermediate level only during a predetermined multiple number of strokes for advancing the ratchet at a lesser rate following timeout of the main program. Upon the advance pawl reaching the end of the segment of teeth having an intermediate root diameter, the pawl drops to a segment having teeth of the least root diameter for slowest advancement of the program cam.

The present invention provides differing rates of cam advance for the main program interval and a terminal portion thereof and a third rate of cam advancement for a subsequent auxiliary function interval during which appliance function is controlled by a subinterval cam-cycled switch.

The slowest rate of advance is employed for the auxiliary function which comprises either "DELAYED START" or "KEEP-WARM", or both. The intermediate faster advance rate is employed for program interval timing in the range 5–35 minutes. During the terminal five minutes of the main program interval, the pawl contacts advance ratchet teeth of the greatest root diameter for fastest advance of the program cam, thereby providing high resolution accurate power switch operation by the program cam. The expanded scale or fastest rate of cam advance is also used for program intervals initially selected in the 0–5 minute range for high-resolution switching.

The present invention thus provides the solution to the above described problem of enabling a single motor driven programmer timer to provide plural rates of program cam advance for main, auxiliary and subinterval timing of appliance functions during the program sequence; and, an expandable scale fast rate of advance is provided for high resolution timing of short interval programs of less than five minutes and the terminal five minutes of longer programs.

BRIEF DESCRIPTION OF THE DRAWINGS

FIG. 6 is a switch sequence diagram for the primary and secondary switching mechanisms of FIG. 2.

DETAILED DESCRIPTION

Figure 1:
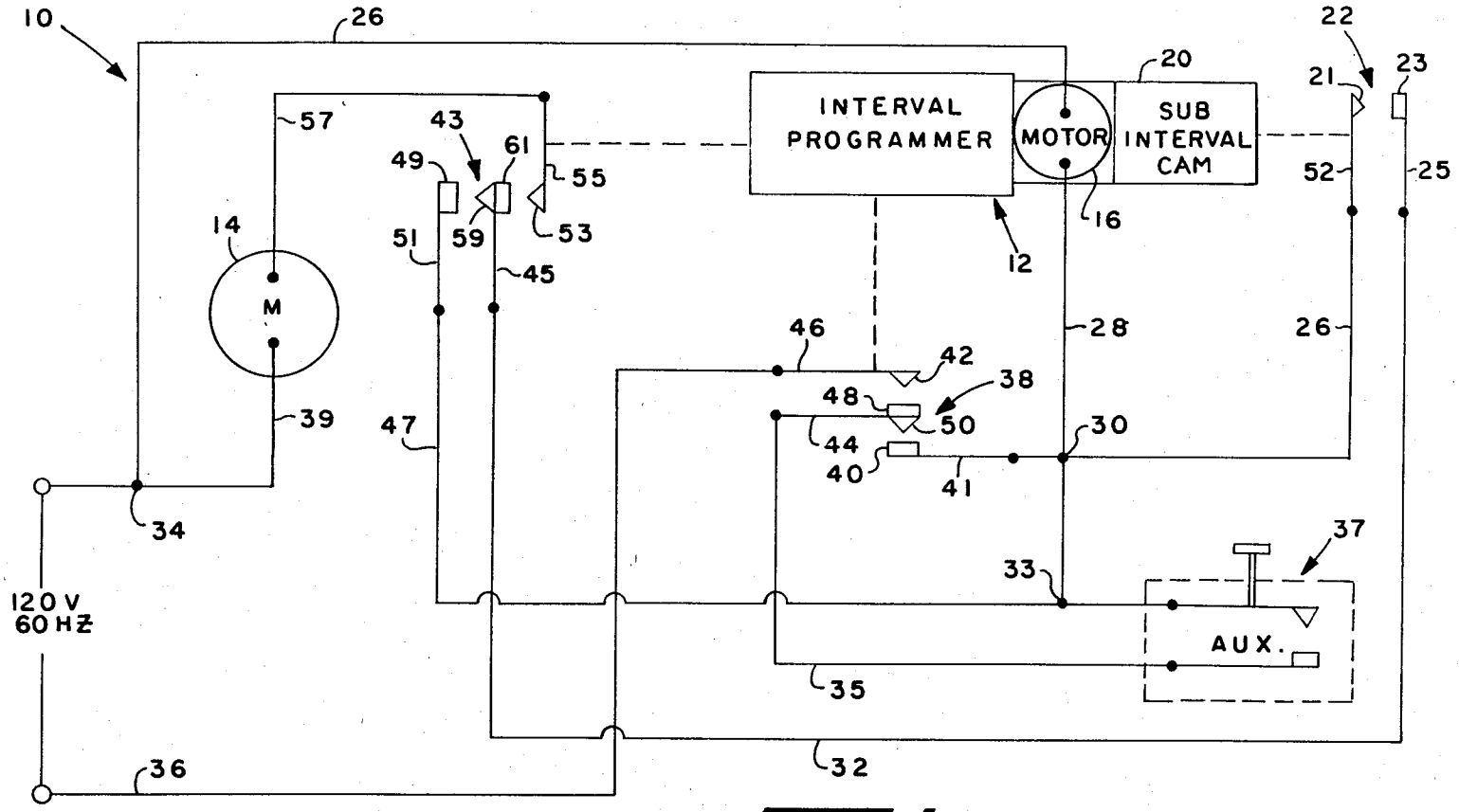
FIG. 1 is a schematic of the control system of the present invention as applied to a microwave cooking appliance application; and, FIG. 2 is a partial perspective of portions of the program cam advance and switching mechanism of the system of FIG. 1.
Figure 2:
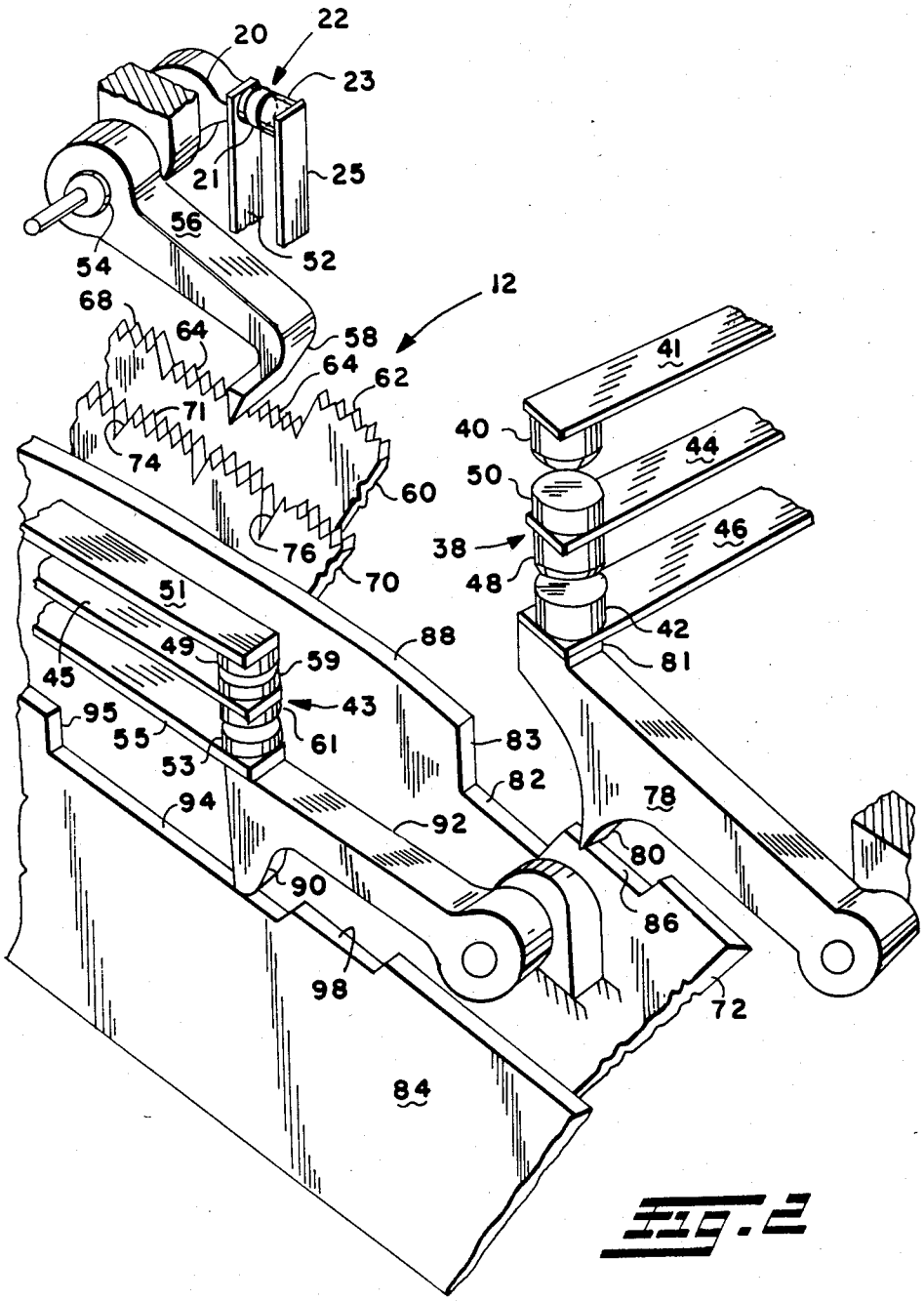

Referring now to FIGS. 1 and 2, the present invention is illustrated as embodied in an appliance control system indicated generally at 10, with a programmer/-timer indicated generally at 12 for controlling energization of an appliance load illustrated in FIG. 1 as a magnetron 14 for a microwave cooking appliance.

The programmer/timer 12 employs a timing motor 16 which is connected through a suitable gear train (not shown) to provide timed rotation to a shaft 18. The shaft 18 has a sub-interval cam 20 provided thereon which upon rotation actuates and deactuates a switch indicated generally at 22 which has one contact 21 thereof mounted on a contact arm 52 connected via lead 26 to junction 30 which is connected via a lead 28 to one side of timing motor 16. Switch 22 has the remaining contact 23 mounted on a contact arm 25.

The magnetron 14 has one terminal thereof connected via a lead 39 to power line junction 34, which is also connected through a lead 26 to the remaining terminal of the timing motor 16.

A primary main programming switch indicated generally at 38 has three contact arms as shown in FIG. 1, and has one side contact 40 (shown as the top terminal in FIG. 2) thereof mounted on contact arm 41 which is connected via a lead to junctions 30 and 33. Switch 38 a central moveable contact arm 44 which is connected via a lead 35 to one side of an auxiliary function selector switch indicated generally at 37. The remaining side contact 42 of the switch 38 is connected to a side contact arm 46 for closing with contact 48 and is connected via lead 36 to the opposite side of the power supply line from junction 34.

The side contact arm 46 is operatively connected, as will hereinafter be described, to the main program timing mechanism of the programmer/timer 12.

The moveable contact arm 52 of switch 22 is operatively connected, as will hereinafter be described, to the sub-interval timing mechanism of the programmer/-timer 12 which connection is shown simply by a dashed line in FIG. 1.

A secondary main program switch, indicated generally at 43, having three contact arms, has the center contact arm 45 thereof connected via lead 32 to the contact arm 25 of sub-interval switch 22. Switch 43 has one side contact 49 mounted on a switch arm 51 which is connected by lead 47 to the junction 33. Switch 43 has a second side contact 53 disposed on the opposite side of arm 45 from contact 49 and mounted on a contact arm 55 which is connected via lead 57 to one terminal of the magnetron 14. The remaining terminal of the magnetron is connected to power line junction 34 via lead 39 as heretofore described.

A contact 59 is exposed on one side of the center switch arm 45 for contacting the side contact 49, and an oppositely disposed contact 61 is mounted on the center switch arm 45 for contacting the switch side contact 53.

Switch 43 is operated by a mechanical connection to the interval program timing mechanism of programmer timer 12 as will be hereinafter described; and, such connection is shown simply by a dashed line in FIG. 1.

Referring now particularly to FIG. 2, shaft 18 has an eccentric 54 provided thereon which has received thereover one end of an advance pawl 56 for providing oscillating longitudinal movement of the advance pawl upon rotation of the shaft 18. The advance pawl 56 has the free end thereof formed to a ratchet engaging chisel-point anvance pawl 58 for contacting a toothed ratchet wheel.

Figure 3:
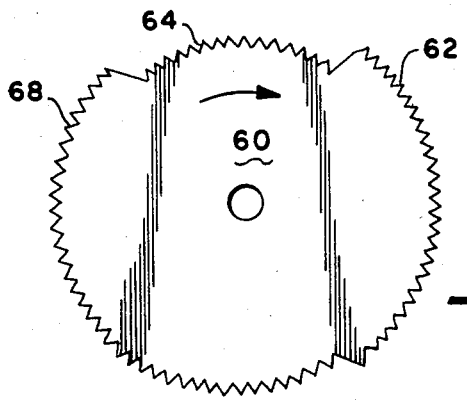
FIG. 3 is a profile view of the toothed advance ratchet wheel for the mechanism of FIG. 2.

Referring to FIGS. 2 and 3, an advance ratchet wheel 60 is provided having a plurality of teeth formed in the outer periphery thereof. The teeth are disposed in discrete arcuate segments having teeth of differing root diameters, but common pitch as shown in profile in FIG. 3. One arcuate segment comprises a subtended central arc of approximately 125° and has a plurality of teeth 62 having the largest root diameter. Teeth 62 are used for expanded scale or fastest rate of advancement. The teeth 62 end abruptly with a steep-ramp radially inwardly to teeth 64 which have the lowest root diameter and which extend for a subtended central angle of approximately 80°. The teeth 64 define a segment of the advance rachet wheel 60 used for auxiliary mode function at tne slowest rate of advancement. For convenience of timing, it has been found satisfactory to provide teeth of a pitch about the circumference of the ratchet wheel corresponding to a single pitch subtending a central angle of five degrees (5°).

The arcuate segment of teeth 64 is terminated circumferentially by the steep-ramp extending radially outwardly therefrom to an arcuate segment of teeth 68, which have a root diameter intermediate that of the teeth 64, 62 and which extend circumferentially around the ratchet wheel to a steep-ramp radially outwardly to teeth 62. All of the teeth 62, 64 and 68 have a common circumferential pitch and are suitably configured for engagement by the chisel point of the advance pawl 58.

Referring to FIG. 2, masking ratchet wheel 70 is disposed in coaxial side-by-side arrangement with the advance ratchet wheel 60. The advance ratchet wheel 60 is drivingly connected to a coaxially disposed program cam wheel 72; whereas, masking ratchet wheel 70 rotates freely with respect to the program cam and the advance ratchet 60.

The masking ratchet wheel 70 has a plurality of peripheral teeth 71 having a common pitch and root diameter with the teeth 62 of the advance ratchet. The masking ratchet wheel 70 has a plurality of deep notches 74 formed in the teeth 71 which deep notches are spaced circumferentially therealong by a desired multiple number of the teeth 71. The root diameter depth of the deep notches 74 coincides with the root diameter of the teeth 68 on the advance ratchet. In the presently preferred practice, the deep notches 74 are arranged such that the point of pawl 58 drops into one of the deep notches 74 every sixth (6th) stroke of the pawl 58 to give the wheel 70 a rate of advance on the intermediate teeth 68 equal to one-sixth (1/6th) of the rate of advance on outer teeth 62.

The masking rachet wheel 70 also has at least one very deep notch 76 disposed about the periphery thereof and having the depth thereof such that the bottom of the notch 76 coincides with the root diameter of the inner teeth 64 of the advance ratchetwheel 60. The rate of advance of the ratchet wheel on inner teeth 64 is thus substantially slower than that of the intermediate teeth 68. In the presently preferred practice, the single very deep notch 76 on the masking racket wheel 70 causes the pawl 58 to advance the ratchet wheel 60, on inner teeth 64, at a rate of one-tenth (1/10th) of the rate on intermediate inner teeth 68, or one-sixtieth (1/60th) of the rate on outer teeth 62.

Figure 4:
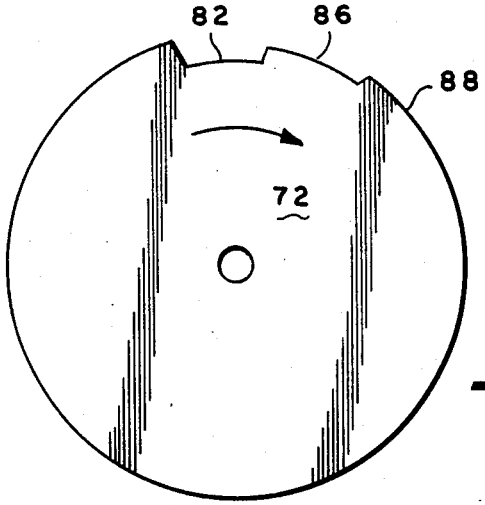
FIG. 4 is a view similar to FIG. 3 for the primary program cam track wheel.

A pivotably mounted lever arm 78 has a cam follower 80 provided thereon and a lifting portion 81 on the end thereof which contacts the side contact arm 46 for providing actuation of the switch 38. The cam follower 80 initially engages a cam surface 82 corresponding to the "OFF" function of the program cycle. Upon manual rotation of the program cam wheel 72 by the appliance operator in the direction shown by the black arrow in FIG. 4, the cam follower 80 is lifted by the steep-ramp 83 and a second raised cam surface 88 which corresponds to the "DELAYED START" portion of the program; and, cam follower 80 is set by the operator to a desired initial position circumferentially along cam surface 88 which extends circumferentially about the periphery of the program can wheel 72. An auxiliary program function cam surface 86 is disposed circumferentially on the wheel 72 adjacent the "OFF" notch 82 and the surface 86 is intermediate cam surface 88 and notch 82. The auxiliary function cam surface is employed in the present practice of the invention for the "KEEP-WARM" program function as will be hereinafter described. Preferably, the "OFF" notch 82 subtends a central angle of twenty degrees (20°) and "KEEP-WARM" track 86 subtends a central angle of thirty degrees (30°) as shown in FIG. 4.

The outer cam wheel surface 88 of program cam 72 also provides the "COOK" function of the program by providing for continuous energization of the magnetron subsequent to "DELAYED START".

Figure 5:
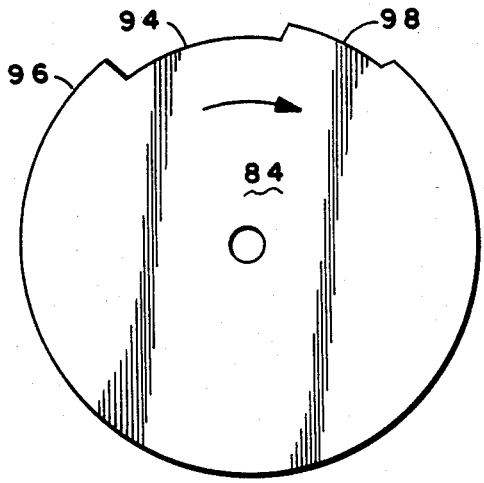
FIG. 5 is a view similar to FIG. 3 for the secondary program cam track wheel.
Figure 5:
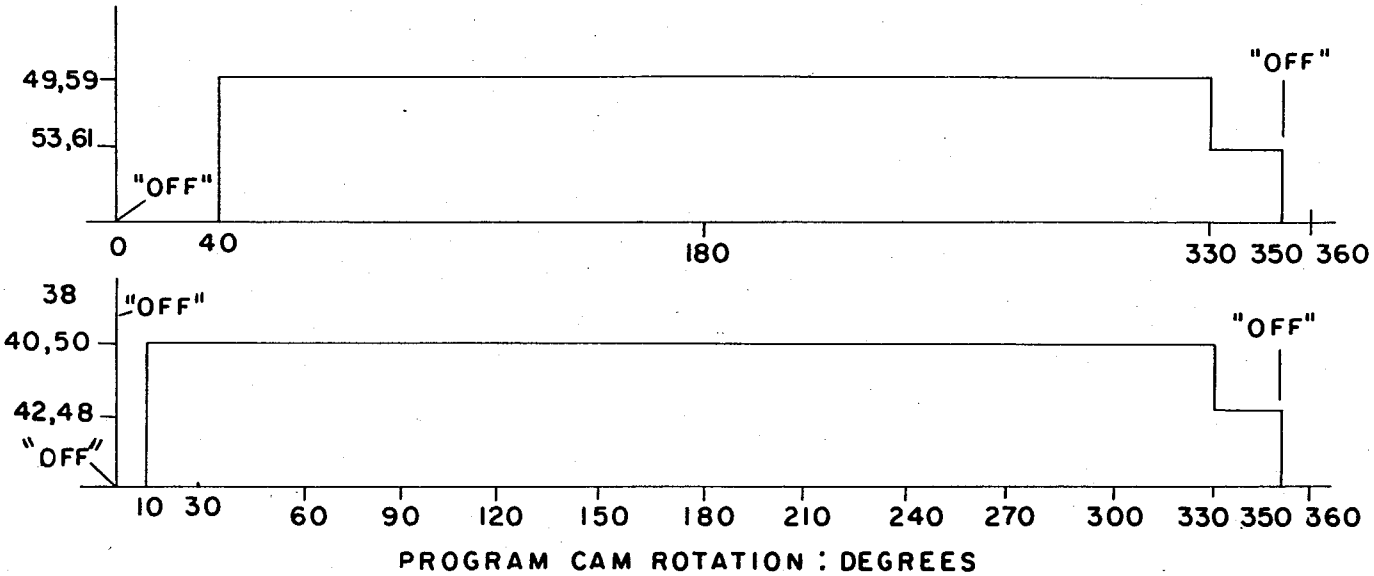

Referring to FIGS. 2 and 5 a secondary program cam wheel 84 is disposed coaxially with program cam wheel 72 and is also connected for driving rotation with ratchet wheel 60 in the direction shown by the black arrow in FIG. 5. The wheel 84 also has a peripheral cam track which is contacted by a cam follower 90 provided on pivotal arm 92 which is operable to lift the arm of 55 switch 43.

The secondary program can wheel 84 has an "OFF" notch or cam track 94 which is the radially most inward track on wheel 84. With reference to FIG. 5, cam track 94 extends along the circumference so as to subtend a central angle of fifty degrees (50°) and, terminates in a steep-ramp 95 extending radially outward. Ramp 95 intersects cam track 96, which comprises the "COOK" function track for closing both sets of contacts of switch 43. Cam track 96 extends about the majority of the periphery of wheel 84 and terminates in a steep-ramp radially inwardly to a cam track 98 radiallly intermediate tracks 94 and 96.

Cam track 98 extends circumferentially to terminate in a steep-ramp extending radially inwardly to "OFF" track 94. Cam track 98 comprises the auxiliary "KEEP-WARM" mode function track for moving contact arm 55 sufficient for maintaining only contacts 53, 61 of switch 43 in the closed position with contants 49, 59, open. In the present practice, it has been found satisfactory to configure the auxiliary "KEEP-WARM" track 98 to subtend a central angle of thirty degrees (30°).

The operation of the programmer/timer will now be described with respect to the appliance control system illustrated in FIG. 1, wherein the appliance load comprises the magnetron of a microwave cooking oven. With the program cam wheel 72 positioned such that cam follower 80 contacts the "OFF" notch 82, switch 38 is in the open position with respect to both sets of contacts; and, the point of pawl 58 is permitted by deep notches 74 in the masking ratchet wheel 70 to contact the inner teeth 64 of the advance ratchet wheel 60. With cam wheels 72, 84 in this position, power is completely cut off to the timer motor 16 and the magnetron 14.

Upon operator manual advancement of the program cam 72 to cause the cam follower 80 to rise to cam surface 88, side contact arm 46 of switch 38 is moved to a position closing contacts 42, 48 and 50, 40 and thereby applying line voltage to junctions 33, 30. Closing of contacts 40, 50 completes a circuit through the timing motor which thereby begins rotation of shaft 18 for oscillating the advance pawl 56. With the cam wheel 72 rotated to a position such that cam follower 80 is lifted on surface 88, the advance point of pawl 58 is position over the teeth 64 of the ratchet wheel 60 and the programer/timer is thus set in the "DELAYED-START" mode. In this latter mode of operation, the pawl 56 advances the ratchet wheel 60 only once upon encountering each of the deep notches 74 in the masking ratchet. Upon completing the segment of teeth 64, the pawl climbs the steep-ramp to intermediate teeth 68 and continues to advance the cam follower along cam surface 88 at the faster intermediate rate as described hereinabove with respect to pawl contact of teeth 64. The magnetron remains energized for the remainder of the program interval which is timed out by the ratchet pawl 56 advancing the ratchet wheel 60 in cam wheels 72, 84 for the remaining portion of the arcuate segment of teeth 68.

Upon the advance pawl reaching the end of the segment of ratchet teeth 68, the pawl is lifted by the steep-ramp to teeth 62 for advancing the cam wheels 72, 84 at the fastest rate corresponding to one tooth 62 for each stroke of the pawl. The terminal portion, comprising the last five minutes of the "COOK" mode is thus timed out along the segment of ratchet teeth 62. The terminal portion of the interval is timed out by the pawl 56 contacting the teeth 62 of the largest root diameter which enables the pawl to advance the advance ratchet wheel 60 and 60 cam 72 one tooth notch for each stroke of the pawl. This rapid rate of advancement provides for high resolution timing of the terminal portion of the program interval thereby enabling precision movement of the switch 43 by the programmed cam since the ramp slope of the cam surface will provide a lesser amount of cam follower movement with each notch indexed movement of the cam. Upon reaching the end of the segment of teeth 62, the point of pawl 58 drops to the teeth 64.

When the point of advance pawl 58 reaches the end of teeth 62, cam follower 80 drops to surface 86 causing contact arm 46 to open contacts 40, 50 of switch contact 38; and, simultaneously cam follower 90 drops to track 98 causing contact arm 55 of switch 43 to open contacts 49, 59. At this point, if auxiliary selector switch 37 is open, power is cut off to both the timer motor 16 and magnetron 14. If, however, the appliance operator has selected the auxiliary or "KEEP-WARM" function by having closed switch 37, power is maintained to junctions 30, 33 and to the timing motor through switches 38, 43; and, thus the pawl 56 continues to oscillate and advance the rachet wheel 60 over teeth 64, thereby changing to the slowest rate of advance by virtue of contacting the teeth 64 only upon point of pawl 58 dropping into tne very deep notch 76.

Continued rotation of the timing motor 16 in the "KEEP-WARM" mode causes subinterval cam 20 to rapidly close and open switch 22 for cycling power to the magnetron 14 for subinterval duty-cycling sufficiently only to maintain the temperature of the contents of the oven. Upon continued advancement of ratchet wheel 60 the "KEEP-WARM" mode to a position in which the pawl 58 engages the central portion of the segment of teeth 64, cam wheel 72 is thereby rotated to a position such that cam follower 80 drops from surface 86 to track 82 thereby opening contacts 42, 48 of switch 38 for breaking the circuit to the switch 37 and the timing motor. Simultaneously, cam wheel 84 is rotated to a position such that cam follower 90 drops from track 98 to track 94 and causes contact arm 55 to open contacts 53, 61 of switch 43, thereby breaking the circuit to the magnetron and leaving the appliance "OFF". Referring to FIG. 6, the sequencing arrangement of the tracks of the cam wheels 72, 84 is shown for the preferred arrangement of controlling actuation of switches 38, 43 as the cam wheels are rotated through a full 360° by the ratchet wheel 60.

In the present practice, it has been found satisfactory to have the subinterval cam 20 rotate one complete revolution in 15 seconds; and, to have the cam configured to close switch 22 for a minor fraction of the period of revolution of the cam 20.

The arrangement of the ratchet wheel 60, whereby the advance pawl contacts teeth 62 for advancement through a substantial arcuate segment of the ratchet wheel during the terminal portion of program timeout, provides a unique capability to the programmer/timer of the present invention. It will be readily understood by those skilled in the art, that if the program interval is selected initially such that the program cam is advanced to a position whereby the pawl contacts the segment of teeth 62 upon startup of the timing motor, the program may be a short interval "COOK" program of five minutes or less. The expanded scale advancement of the ratchet wheel over teeth 62 thus provides a high degree of accuracy of switching for any period within the interval represented by the arcuate segment of ratchet teeth 62. The arrangement of the ratchet wheel 60 thus provides accurate timing of the terminal portion of a program for which the cam has been initially positioned for both delayed start and normal cooking, but also provides very accurate timing of short interval programs.

Although the invention has been herein described as practiced in the presently preferred form, it will be understood that the invention is capable of modification and variation within the scope of the following claims.

What is claimed:

1. An electromechanical programmer timer for controlling energization of an electrical appliance comprising:

(a) motor means operative upon connection to a source of electrical power to provide rotation of a motor shaft;

(b) pawl means operatively connected to said motor shaft for oscillatory movement upon energization of said motor means;

(c) program cam means operable upon operator positioning and subsequent advancement for effecting a selected timed program of appliance function;

(d) advance means including ratchet means engaged by said pawl means, said ratchet means being operative to advance said cam means step-by-step upon said oscillatory motion of said pawl means, said ratchet means including a rotatable member having;

(i) a segment of peripheral teeth having a first root diameter for providing expanded scale advancement;

(ii) a segment of peripheral teeth having a second root diameter less than said first root diameter for auxiliary function scale advancement;

(iii) a segment of peripheral teeth having a third root diameter intermediate said first and second root diameters for compressed scale advancement;

(d) masking means operable to permit said pawl means to advance said cam means at a first expanded scale rate corresponding to the rate of oscillation of said pawl means when said pawl means engages the teeth of said first root diameter, said masking means operable to permit said pawl means to engage said teeth of said third root diameter only once out of a first predetermined number of oscillations of said pawl means giving said cam means a second rate of advance equal to said expanded scale rate multipled by the reciprocal of said first predetermined number, said masking means further operable to permit said pawl means to engage said teeth of said second root diameter only once out of a second predetermined number of oscillations of said pawl means, said second number being greater than said first predetermined number, giving said cam means a third rate of advance said expanded rate multiplied by the reciprocal of said second predetermined number; and, (e) switch means operatively responsive to advance of said cam means to sequentially energize and de-energize said motor means and said appliance in accordance with said selected program.

2. The programmer timer defined in claim 1, wherein:

(a) said ratchet means rotatable member comprises an advance ratchet wheel; and, (b) said masking means comprises a masking ratchet wheel mounted for rotation about a common axis with said rotatable member, said masking ratchet having peripheral teeth of the same root diameter as said advance ratchet teeth first root diameter and having a plurality of deep notches spaced along the periphery thereof at intervals corresponding to the pitch of said first root diameter teeth multiplied by said first predetermined number, said deep notches having the root diameter thereof corresponding to that of said third root diameter teeth, said masking ratchet having at least one very deep notch provided on the periphery thereof at intervals corresponding to the pitch of said second root diameter teeth multiplied by said first predetermined number, said very deep notches having the root diameter thereof corresponding to that of said second root diameter teeth.

3. The programmer timer defined in claim 1, wherein said rotary means includes a cam wheel having first, second and third cam surfaces formed on the periphery thereof for effecting said sequenced operation of said switch means.

4. The programmer timer defined in claim. 1, wherein:

(a) said rotary cam means includes a cam wheel having first, second and third level cam surfaces on the periphery of said wheel;

(b) said switch means includes cam follower means operable upon contacting said first level cam surface to cause said switch means to be in the open circuit condition and upon said cam means being advanced to cause said cam follower means to contact said second level cam surface, said switch means closes a first circuit to energize said motor means and upon said motor means and pawl means advancing said cam means to cause said cam follower means to contact said third level cam surface, said cam follower effects operation of said switch means for closing a second circuit adapted for energizing said electrical applicance.

5. The programmer timer defined in claim 1, wherein said ratchet means segment having said second root diameter teeth has a toothless sub-segment intermediate the ends thereof wherein upon said masking means permitting said ratchet pawl means to engage said second root diameter teeth and upon desired advancement therealong to said toothless sub-segment, said cam means is effective to cause said switch means to go open circuit for de-energizing said motor means and said external electrical appliance.

6. An electromechanical programmer timer for controlling energization of an electrical appliance comprising:

(a) motor means operable upon connection to a source of electrical power to provide timed rotation of a power shaft;

(b) switch means operable upon actuation and deactuation to energize and de-energize said motor means and said appliance;

(c) cam means operable operator intitial positioning and upon timed advancement to actuate and deactuate said switch means in accordance with a selected program;

(d) advance means connected to said power shaft and operable to advance said cam means in accordance with a selected program;

(i) oscillating pawl means, (ii) a ratchet wheel having plural segments of ratchet teeth for engagement by said pawl means with a first segment of teeth having a first root diameter for rapid advance, a second segment of teeth having a second root diameter significantly less than said first segment teeth, a third segment of teeth having a third root diameter intermediate said first and second root diameters, (iii) masking means operable upon operator selection of a desired program having a timed interval greater than a predetermined minimum to cause said pawl means to engage said third segment of teeth for indexing therealong, said masking means operable, upon operator selection of and time down to a program interval less than said minimum, to cause said pawl means to engage said first segment of teeth for rapid advance of said cam means during time-out of the remainder of said interval, said masking means operable upon operator selection of an auxiliary mode function position of said cam means to cause said pawl to engage said second segment teeth for indexing therealong, said masking means further operative to cause said pawl to contact said second segment teeth upon time-out of said selected program interval.

7. An appliance control system comprising:

(a) electrical appliance function means operable upon electrical energization to perform an appliance function;

(b) a motor operable upon electrical energization to provide power to a rotary shaft means;

(c) switch means operable upon actuation and deactuation to energize said motor means and said appliance function means;

(d) program cam means selectively positionable by the appliance operator to an initial position corresponding to a selected program and operable upon advancement to actuate and de-actuate said switch means in accordance with said program; and, (e) advance means connected to receive power from said shaft means and operable to advance said cam means from said initial position for accomplishing said program to a timed-out position, wherein upon said operator selection of an initial cam position corresponding to a program time interval less than a predetermined minimum, said advance means is operable to advance said cam means at a first expanded scale rate to provide a fastest rate of cam advancement, and upon operator selection of an initial cam position corresponding to a program time interval greater than said minimum, said advance means is operable to advance said cam means at a compressed scale rate substantially slower than said expanded scale rate, said advance means further operable, upon operator selection of an auxiliary mode cam means position, to effect actuation of said switch means to initially energize said motor means and advance said cam means at a rate slower than said compressed scale rate for effecting selected delayed actuation of said switch means to energize said function means.

8. The control system defined in claim 7, further comprising:

(a) subinterval switch means; and, (b) sub-interval cam means receiving power from said shaft means and operable to actuate and deactuate said subinterval switch means at predetermined subintervals of the selected programs interval for providing sub-interval appliance function during said auxiliary mode slowest advancement of said cam means.

9. The control system defined in claim 7, wherein said advance means includes:

(a) a ratchet wheel having a first segment of teeth of a first root diameter for said expanded scale advance rate, a second segment of teeth of a second root diameter less than said first root diameter for said compressed scale advance rate, a third segment of teeth of a third root diameter intermediate said first and second root diameters for an advance rate intermediate said expanded scale and said compressed scale advance rates;

(b) pawl means connected to said shaft and operable to oscillate upon rotation of said shaft means and for engagement of said ratchet teeth; and, (c) masking means operable upon operator selection of a program interval less than said minimum to permit said pawl means to engage said first segment of ratchet teeth for step advancement of said cam means with each oscillation of said pawl means, said masking means operable upon operator selection of a program interval of at least said minimum, to permit said pawl means to engage said third segment of ratchet teeth only once upon each of a first multiple of said pawl oscillations, said masking means further operable upon operator selection of said auxiliary mode function to engage said third segment of ratchet only once upon each of a second multiple of said pawl oscillations, said second multiple being greater than said first multiple.

10. The control system defined in claim 7, wherein said first, second and third teeth segments have a common tooth pitch.

11. An electromechanical programmer timer for controlling an electrical appliance comprising:

(a) motor means operable upon connection to a source of electrical power to provide rotation of a shaft means;

(b) load switch means adapted for, upon actuation and deactuation to energize and de-energize said appliance from a source of power;

(c) timing switch means operable upon actuation and deactuation to energize and de-energize said motor means and third switch means electrically in parallel with said first switch means (d) program cam means selectably positionable at an initial position by the appliance operator and operable upon timed advancement to provide a preselected program of actuation and deactuation of said first and second switch means;

(e) advance means operable, upon rotation of said shaft means to provide sequential advancement of said cam means from said initial position for said selected interval to a timed-out position in which said load and timing switch means are deactuated;

(f) sub-interval cam means operable in response to rotation of said shaft means to actuate and deactuate said third switch means at for a predetermined fraction of the period of rotation of said shaft;

(g) said advance means including delay means operable, upon operator selection of an auxiliary function initial position of said cam means, to actuate said timing switch means and advance said program cam means at a slowest rate for a selected interval before actuating said load switch means, whereupon said program cam means is advanced at a faster rate for an appliance program interval, wherein as said program interval is timed out, said advance means is operative to advance said program cam means at a fastest rate for time-out of a predetermined terminal portion of said program interval, said fastest rate of advance of said program cam means.

12. The programmer timer defined in claim 11, wherein said advance means includes a ratchet wheel and pawl means connected to said shaft means and engaging said ratchet, and operable to oscillate for indexing said ratchet upon rotation of said shaft, said ratchet wheel having a first segment of teeth of a first root diameter, a second segment of teeth of a second root diameter and a third segment of teeth of a third root diameter, said advance means further including a masking ratchet operable to permit said pawl to engage said first segment teeth with each oscillation thereof, said masking ratchet operable to permit said pawl to engage said second segment teeth only once for each of a first multiple of said oscillations, said masking means operable to permit said pawl to engage said third segment teeth only once for each of a second multiple of said oscillations, wherein said second multiple is greater than said first multiple.

13. The programmer timer defined in claim 12 further comprising:

(a) an auxiliary function switch operable upon actuation and deactuation to shunt said load switch for energizaing and de-energizing said appliance; and, (b) sub-interval cam means connected for rotation by said shaft means and operable to actuate and deactuate said auxiliary function switch for an interval not exceeding a minor function of the selected appliance program interval.

14. An electromechanical programmer timer for an electrically energized appliance comprising:

(a) timing motor means operable to provide rotation of a shaft means at a predetermined rate;

(b) a load switch operable for actuation and deactuation and adapted for energizing and de-energizing an appliance;

(c) timing switch operable upon actuation and deactuation to energize and de-energize said motor means;

(d) program cam means operator positionable at a selected initial position and operable upon timed advancement to actuate and deactuate said switches for providing a selected program of appliance operation; and, (e) advance means connected to said shaft means and operable, upon rotation of said shaft means, to step-index said program cam means from said initial position to a timed-out position, for providing the selected program interval said advance means operable in response to a first mode of initial position of said cam means corresponding to minimum program intervals to advance said program cam means at a first expanded rate for time-out, said advance means, in response to a second mode of initial positions of said program cam means corresponding to program intervals greater than said first mode, operable to advance said program cam means at a second rate less than said first rate, said advance means, in response to a third mode of initial positions of said program cam means corresponding to an auxiliary mode function program, operable to advance said program cam means at a third rate, wherein for said third mode initial positions, said motor switch means is actuated and actuation of said load switch means is delayed thereafter until elapse a selected interval.

15. An electromechanial programmer timer for an electrically energized appliance comprising, (a) timing motor means operable to provide rotation, of a shaft means at a predetermined rate;

(b) a motor switch operable upon actuation and deactuation to energize and de-energize said motor means;

(c) a load switch operable for actuation and deactuation and adapted for energizing and de-energizing said appliance;

(d) program cam means selectively positionable by the operator of said appliance to an initial position and operable upon timed advancement to actuate and deactuate said switches for providing a selected program of appliance operation;

(e) an auxiliary function switch operable upon actuation to shunt said load switch;

(f) advance means connected to said shaft means and operable upon rotation of said shaft means to step-index said program cam means for the selected program interval from said initial position to a timed-out position, said advance means operable in a first mode of initial positions of said program cam means corresponding to a minimum program interval to advance said program cam means at a first expanded rate for time-out, said advance means in response to a second mode of initial positions of said program cam means is operable to advance said program cam means at a second compressed rate less than said first rate, said advance means upon time-out of said selected program interval, operable to advance said program cam means at a third rate for time-out of an auxiliary function interval; and, (g) sub-interval cam means connected for rotation by said shaft means and operable to actuate and deactuate said auxiliary function switch for intervals comprising a fraction of the period of rotation of said shaft means, wherein said cam means is operable upon program time-out and advancement at said third rate and time-out of said auxiliary interval to effect deactuation of all of said switch means.

* * * * *